US008011414B2

(12) United States Patent
Levy et al.

(10) Patent No.: US 8,011,414 B2
(45) Date of Patent: Sep. 6, 2011

(54) ROLL-UP SHUTTER WITH TILTABLE SLOTS

(75) Inventors: Meir Levy, Rishon Le Zion (IL); Avner Milo, Rishon Le Zion (IL)

(73) Assignee: Moshe Amit Levy, Bar Yaakov (IL)

( * ) Notice: Subject to any disclaimer, the term of this patent is extended or adjusted under 35 U.S.C. 154(b) by 151 days.

(21) Appl. No.: 12/494,387

(22) Filed: Jun. 30, 2009

(65) Prior Publication Data

US 2010/0000691 A1 Jan. 7, 2010

(30) Foreign Application Priority Data

Jul. 2, 2008 (IL) ..... 192586

(51) Int. Cl.
*E06B 9/08* (2006.01)

(52) U.S. Cl. ..... 160/133; 160/116

(58) Field of Classification Search ..... 160/133, 160/188, 115, 116; 49/325
See application file for complete search history.

(56) References Cited

U.S. PATENT DOCUMENTS

| | | | | | |
|---|---|---|---|---|---|
| 3,302,692 | A | * | 2/1967 | Grau | 160/133 |
| 3,429,355 | A | * | 2/1969 | Griesser | 160/133 |
| 3,989,084 | A | * | 11/1976 | Inamura et al. | 160/36 |
| 4,521,993 | A | * | 6/1985 | Tacheny et al. | 49/325 |
| 4,715,421 | A | * | 12/1987 | Erber | 160/133 |
| 5,188,161 | A | * | 2/1993 | Erber | 160/133 |
| 5,566,737 | A | * | 10/1996 | Erber | 160/133 |
| 5,566,738 | A | * | 10/1996 | Yadidya | 160/133 |
| 5,887,636 | A | * | 3/1999 | Neukam | 160/133 |
| 6,453,972 | B1 | * | 9/2002 | Sher et al. | 160/133 |
| 2001/0035270 | A1 | * | 11/2001 | Erber | 160/133 |
| 2010/0000691 | A1 | * | 1/2010 | Levy et al. | 160/133 |

FOREIGN PATENT DOCUMENTS

| | | | |
|---|---|---|---|
| DE | 3917080 | * | 12/1989 |
| EP | 0189091 | * | 7/1986 |
| IL | 17603 | | 6/1964 |
| IL | 19862 | | 11/1966 |
| IL | 22829 | | 9/1968 |
| IL | 37506 | | 6/1975 |
| IL | 111577 | | 4/1998 |
| IL | 123347 | | 9/2001 |

* cited by examiner

*Primary Examiner* — Blair M. Johnson
(74) *Attorney, Agent, or Firm* — Pearl Cohen Zedek Latzer, LLP

(57) ABSTRACT

The invention relates to improvements in a roll-up shutter. More particularly, the invention provides an electrically-driven shutter which can be electrically deployed or retracted, and the slats may be electrically tilted for ventilation or vertically closed for maximum security, all by use of a single electric motor. The invention achieves the above objects by providing an electrically driven roll-up shutter, comprising a plurality of upper pivoted link elements each of which supports all lower components, the linkage pivots being arranged to allow roll-up on a shutter shaft or tube, the lowest of the link elements being attached to a slat tilt mechanism, the upper pivoted link elements when in tension with only the highest of the link elements in contact with the shutter shaft or tube form a substantially straight line.

8 Claims, 7 Drawing Sheets

ROLL-UP SHUTTER WITH TILTABLE SLOTS

CROSS REFERENCE TO RELATED APPLICATIONS

This application claims the benefit of Israeli patent application Serial No. 192586, filed on Jul. 2, 2008 and titled "ROLL-UP SHUTTER WITH TILTABLE SLOTS" which was amended on Oct. 27, 2008 (the material in the Oct. 27, 2008 amendment being part of the priority claim).

FIELD AND BACKGROUND OF THE INVENTION

The present invention relates to improvements in a roll-up shutter.

More particularly, the invention provides an electrically-driven shutter which can be electrically deployed or retracted, and the slats may be electrically tilted for ventilation or vertically closed for maximum security, all by use of a single electric motor.

For brevity, the term "building opening" is used in the present specification to mean both doors and windows.

Roll-up shutters and Venetian blinds are both familiar to most people and need no detailed description. These two items are often found together in openings of residential and public buildings. The purpose of the shutter is to prevent passage of humans, animals and birds. Of course, the shutter is also useful for stopping the entry of solar radiation more than is desired, to provide privacy and to minimize damage during a severe storm. The shutter however when deployed allows little ventilation or light to pass.

The Venetian blind is useful for directing incoming solar rays in any desired direction and for totally shielding the window or door opening therefrom and thus provides the privacy desired by those in the building. The Venetian blind provides ventilation but on the other hand it provides almost no barrier to forcible entry.

Sliding shutters provide tiltable slots, however, such shutters require more space for moving same into "pockets" within the building wall.

In the past almost all shutters have been manually operated. However the large area shutters used over a double door and large windows have been difficult to operate by the elderly and by handicapped persons, which led to the development of electrically driven shutters which were found convenient also by the able bodied.

As roller shutters have been intensively developed in Israel, the following review of Israeli patents provides a fair picture of the state of the art. A hand-powered roll up shutter is seen in Israel Patent no. 17,603 to Rosoff, who claims that his design is openable for ventilation purposes. The shutter has cloth interconnection bands which wear quickly and can be cut by household scissors without difficulty by a person determined to enter through the door or window fitted with such a shutter.

A further shutter having some hand-operated tiltable slats is seen in Israel Patent no. 19,862 to Moliplast ltd et al. The roller blind requires manual intervention for tilting the slats.

Grau discloses a tilting roller blind in Israel Patent no. 22,829, wherein pegs connected to said slats cause tilting thereof. The shutter requires vertical guide means, a first auxiliary path and a second auxiliary path and it is unclear how the user is to control the degree of tilt.

Shem-Ur in Israel Patent no. 37,506 discloses a more complex design. The top and bottom slats have bolts at their extremities to which small levers, pliably connected to a chain can be turned, although these two slats retain their vertical orientation. The shutter includes means preventing a person from lifting the shutter upwards. Mechanical means, as well as a hand-operated crank, provide for tilting the slats.

Israel Patent no. 111,577 to Erber et al. discloses a Venetian blind wherein louver slats and adjustable chain links both overlap each other. From the abstract and FIG. 9 available the mode of operation was unclear.

A shutter slat tilting mechanism is also disclosed by Tristeck Ltd. in Israel Patent no. 123,347 wherein a mechanical control allows selective tilting of the slats.

OBJECT OF THE INVENTION

In view of this state of the art it is one of the objects of the present invention to obviate the shortcomings of prior art and to provide a shutter in which both the roll up and the deployed down state, and the slat tilt motion are electrically driven.

It is a further object of the present invention to achieve this while using only a single electric motor.

SUMMARY OF THE INVENTION

The present invention achieves the above objects by providing an electrically driven roll-up shutter for a building opening, comprising a) a plurality of upper pivoted link elements each of which supports all lower components, the linkage pivots being arranged to allow roll-up on a shutter shaft or tube, the lowest of said link elements being attached to a slat tilt mechanism, said upper pivoted link elements when in tension with only the highest of said link elements in contact with said shutter shaft or tube form a substantially straight line;

when rolled up and said link elements are in contact with said shutter shaft and take up a concave form;

when the shutter is fully deployed said link elements are in compression and form a convex curve and act as a push rod;

b) a plurality of interconnected shutter slats, rotatably suspended from opposed ends by one of a chain of interconnected pivoted hinge units, said hinge units being configured to slidingly engage a fixed vertical guide member provided at each side of said building opening, and said hinge units allowing at least 90 degree of slat swing on a horizontal axis and being interconnected by hinge elements to allow roll-up on a shutter shaft or tube, said shutter slats having at each extremity a further pivot engaging said slat tilt mechanism;

c) a reversible electric motor geared to a speed reduction device operatively connected to drive said shutter shaft in either direction;

and d) user control means responsive to at least three commands to said motor including DOWN, UP, and OFF;

whereby said shutter may be electrically driven to a retracted position wherein a major portion of said shutter is rolled up inside the shutter box;

a partially deployed position wherein said slats remain closed;

a stopped fully-deployed position wherein the lowest of said struts encounters an obstacle such as the floor or a fixed window frame; and a slat-open position wherein further operation of said motor activates said slat tilting mechanism allowing air and light to pass through said shutter.

PREFERRED EMBODIMENTS OF THE INVENTION

In a preferred embodiment of the present invention there is provided a shutter for a building opening further including said cylindrical revolvable member, supportable in the existing bearings of a shutter box.

In a further preferred embodiment of the present invention there is provided a shutter for a building opening further including said shutter box.

In a further preferred embodiment of the present invention said motor is placed within the shutters axis tube.

In another preferred embodiment of the present invention there is provided a shutter for a building opening further including automatic stop means to prevent the motor from overriding the up movement and the tilt movement.

In a further preferred embodiment of the present invention there is provided a shutter for a building opening wherein the highest of said upper pivoted link elements is provided with at least one aperture allowing passage for at least one fastener.

In a most preferred embodiment of the present invention there is provided a shutter for a building opening as claimed in claim 1, wherein said upper pivoted link elements are formed to lie snugly against said shutter shaft or tube when said shutter is at least partially retracted.

An important novelty of the present invention is the elimination of any hand lever for tilting the slats. This has been achieved by use of the upper link elements both for tension (supporting the partly deployed slats) and in compression for operating the tilt mechanism It will thus be realized that the novel shutter of the present invention can serve as a retrofit or replacement of a conventional shutter. If the core shaft of the shutter is suitable, the shutter of the present invention is connected thereto. If there is sufficient room in the existing shutter box the shaft of the existing shutter box is replaced by a tube as seen in the drawings.

A preferable option is wherever possible to totally replace the existing shutter box with a new shutter box already containing a tube shaft complete with the shutter and the electric drive according to the present invention The most preferable application is in new buildings under construction where the complete shutter box according to the invention is installed and no modifications are needed.

An auxiliary lever is provided in order to allow operation of the shutter by hand for use during a failure of the power supply, or where the electric motor can not be used due to an explosive atmosphere, an electrical fault or for religious or other reasons. As no novelty is claimed for this item it is not mentioned in the description or drawings.

The slats are normally made of an extruded polymer. However if it is required to maximize security against break-in, the slats can be extruded from an aluminium alloy, advantageously anodized to a desired colour, the extra strength, rigidity and durability thereof justifying the extra cost of the metal.

The tilt mechanism described refers to a shutter embodiment to cover a large building opening. Where however only a narrow window or door is to be shuttered a single tilt mechanism on either the right or the left side of the shutter is all that is needed.

With regard to the danger of a user overrunning the either the UP or the DOWN and TILT movement and thereby damaging the shutter or the motor itself, the arrangement suggested in the present specification can be replaced by various other arrangements or a combination thereof. The reference is to using a slip-clutch and/or a current limiting device set to prevent motor burn-out. A further arrangement is to use a fuse for this purpose. Probably there are further protective means which can be used.

DESCRIPTION OF THE DRAWINGS

The invention will now be described further with reference to the accompanying drawings, which represent by example preferred embodiments of the invention. Structural details are shown only as far as necessary for a fundamental understanding thereof. The described examples, together with the drawings, will make apparent to those skilled in the art how further forms of the invention may be realized.

In the drawings.

FULL DISCLOSURE OF THE INVENTION

Figure 1:
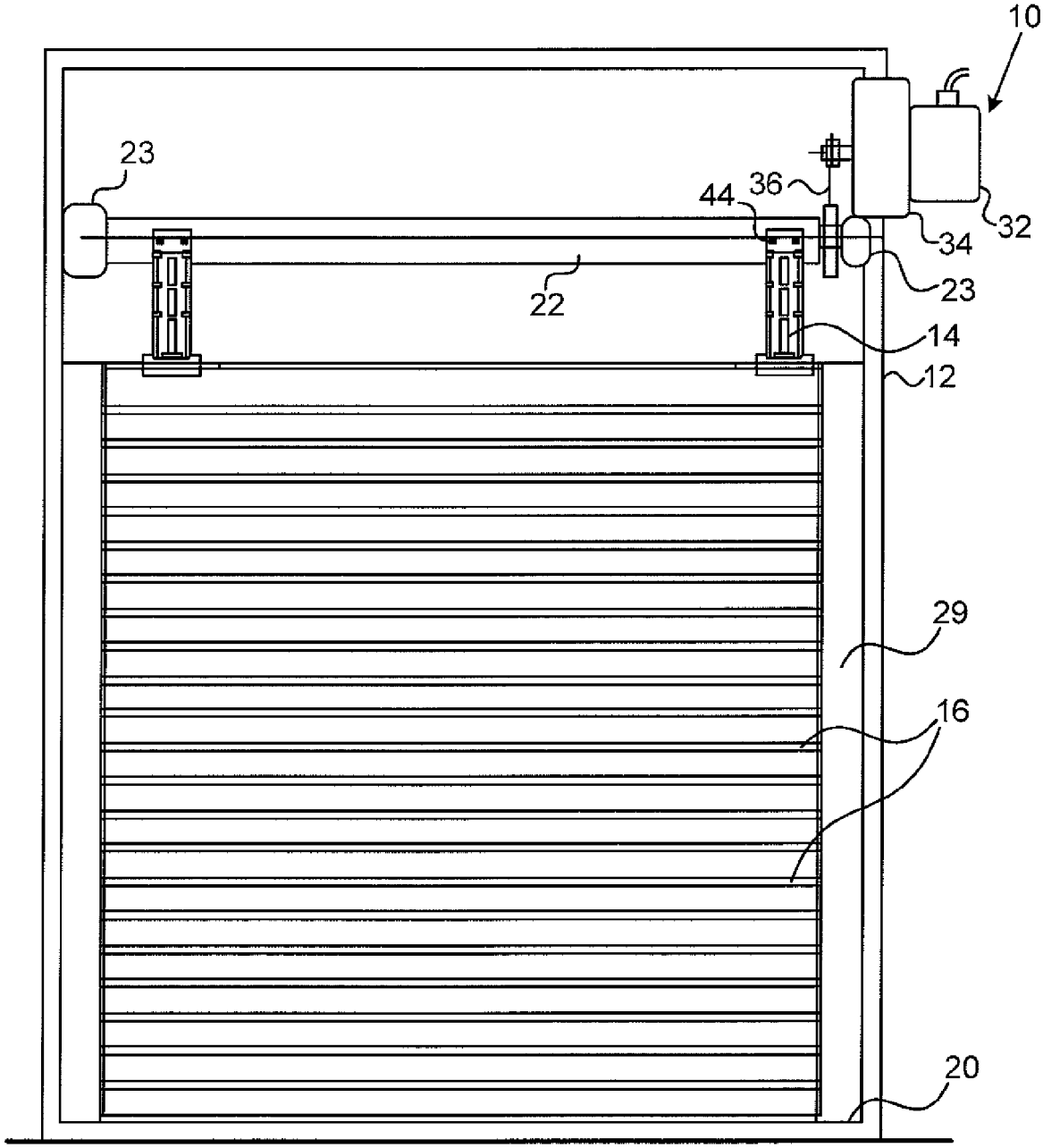
FIG. 1 is an elevational general schematical view of a preferred embodiment of the shutter according to the invention.
Figure 2:
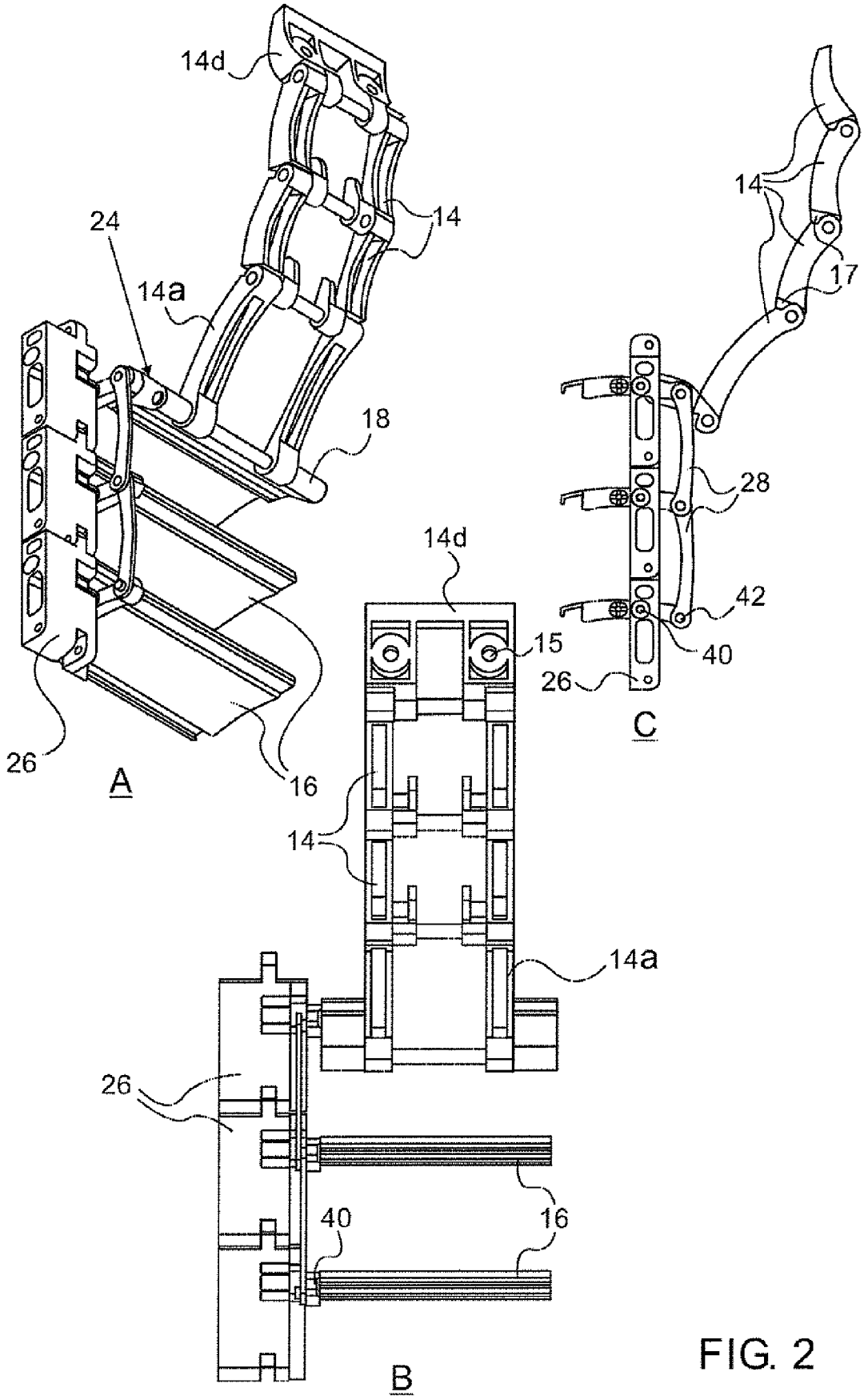
FIGS. 2 *a, b* and *c* are partial illustration of the same embodiment, in perspective elevational and side views.

There is seen in FIG. 1 a non-detailed general view and in FIGS. 2 *a, b* and *c* a detail of the electrically driven roll-up shutter 10 for a window opening 12.

Two sets of four upper pivoted link elements 14 support the slats 16 and the linkage pivots 18 and auxiliary components. Advantageously the highest of the upper pivoted link elements is provided with two apertures 15 allowing passage for screw fasteners 44 for secure attachment thereof to the shutter shaft or preferably tube 22. The tube 22 has means to allow rotary suspension in bearings 23.

Figure 3:
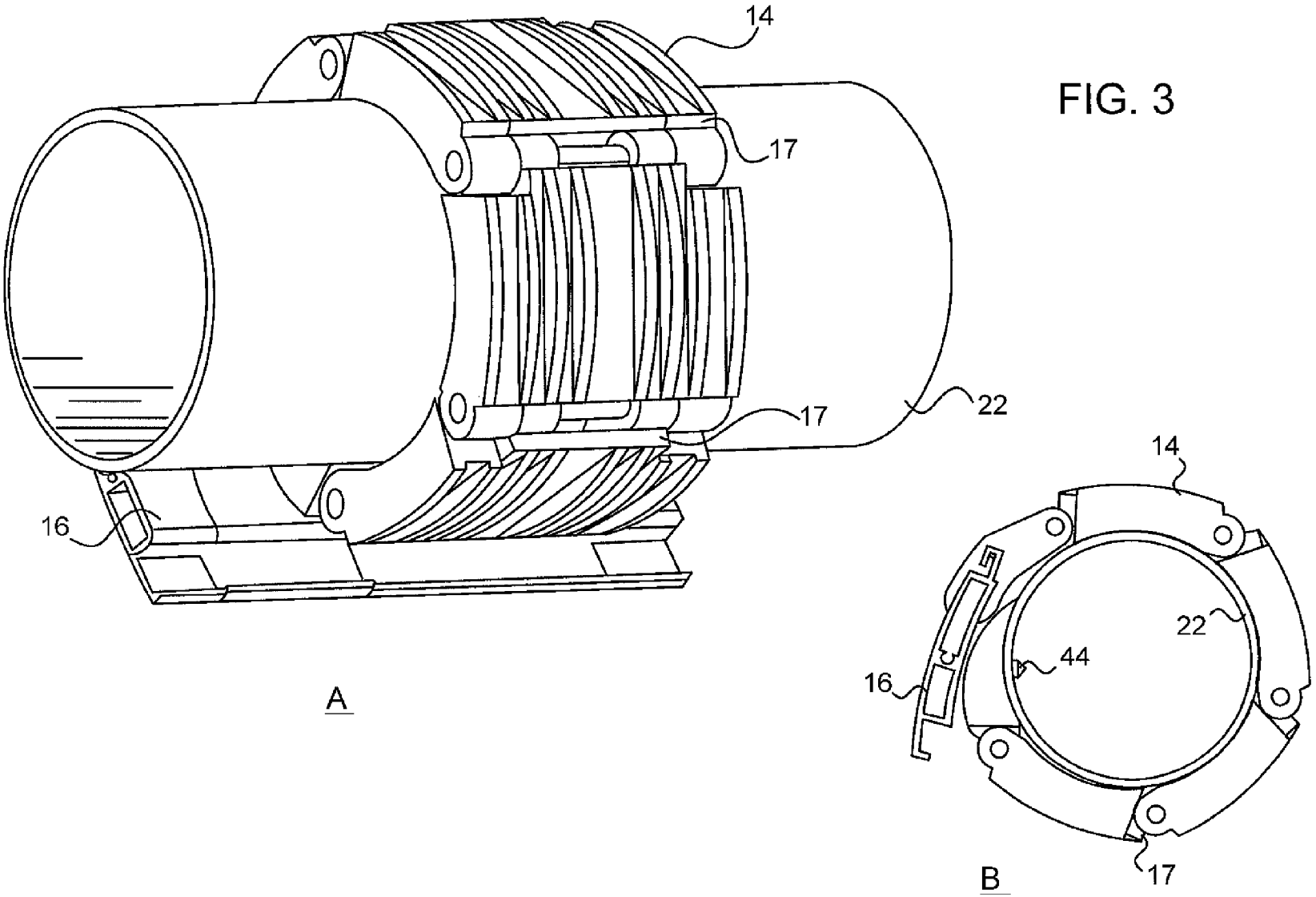
FIGS. 3 *a* and *b* are a perspective and end views of the four upper pivoted link elements having a form and size to fit the roll-up tube.

The pivoted link elements 14 are arranged to allow roll-up on a shutter shaft or tube 22 (as seen in FIG. 3). The lowest 14*a* of the link elements 14 is attached to a slat tilt mechanism 24. The shutter slats 16 have at each extremity a central pivot point 40 and a secondary pivot 42 rotatably engaging a link bar 28 which is part of the slat tilt mechanism 24.

The upper pivoted link elements 14 are in tension when the shutter 10 is deployed but not yet stopped by a frame member 20 or a floor. In this situation only the highest 14*d* of the link elements 14 is in contact with the shutter shaft or tube 22. The upper link elements 14 then form a substantially straight line.

When rolled up, fully or partially, the link elements 14 are in contact with the shutter shaft and take up a concave form. However when the shutter is fully deployed the link elements 14 as seen in FIG. 2 *c* are in compression stopped by shudder 17 and form a convex curve and are employed as a push rod.

A plurality of interconnected shutter slats 16 are rotatably suspended from opposed ends by one of a chain of interconnected pivoted hinge blocks 26. The shutter slats 16 have at each extremity a further pivot 42 engaging the slat tilt links 28. One link 28 is provided at each end of the slats 16, the center to center link length being equal to the center to center spacing of adjacent slats 16, the uppermost slat 16 being driven by the lowest 14*a* of the upper pivoted link elements 14.

Hinge blocks 26 are configured to slidingly engage a pair of spaced-apart fixed vertical guide member 29, typically a metal U channel, provided at each side of a building opening. Hinge blocks 26 allow free rotation for slat swing on a horizontal axis. The hinge blocks 26 are interconnected by horizontal-axis hinge elements, such as a steel pin 30, thereby to allow shutter roll-up on the shutter shaft or tube 22.

A reversible electric motor 32 is geared to a speed reduction device 34 and operatively connected by a chain or timing belt drive 36 to drive the shutter shaft or tube 22 in either direction. It should be noted that the motor could be mounted within tube 22 as known and common in the filed, and seen in FIG. 4.

Figure 4:
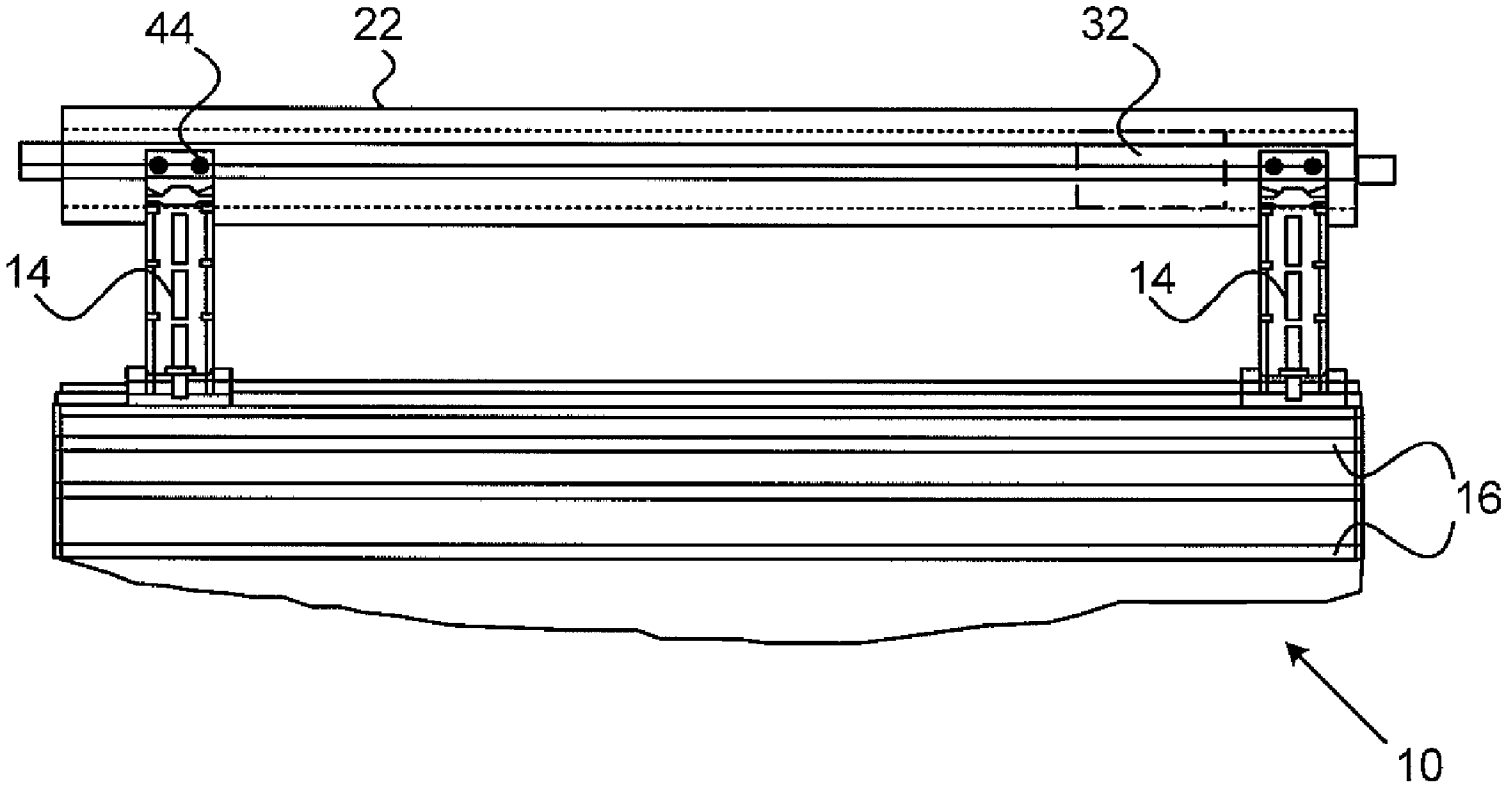
FIG. 4 is an elevational view of an embodiment intended for retrofit application where the motor is mounted within the shaft/tube.

User control (switching) means are provided as will be seen in FIG. 4.

In operation the shutter may be electrically driven to

1) A retracted position wherein a major portion of the shutter 10 is rolled up inside the shutter box 46 seen in FIG. 4.
2) A partially deployed position wherein the slats 16 remain closed.
3) A stopped fully-deployed position wherein the lowest of the slats 16 encounters an obstacle such as the floor or a fixed window frame 20.
4) A slat-open position wherein further operation of the motor 32 activates the slat tilting mechanism 24 allowing air and light to pass through the shutter.

With reference to the rest of the figures, similar reference numerals have been used to identify similar parts.

FIGS. 3*a* and *b* illustrates a further detail of a preferred embodiment of the shutter.

Two spaced-apart sets of four upper pivoted link elements 14 are used, only one set appearing in the figure. The elements 14 are curved and sized to lie snugly against the shutter tube 22 when the shutter is at least partially retracted FIG. 4 illustrates a shutter for a building opening further including the cylindrical revolvable member 22, sized to be supportable in the bearings 23, seen in FIG. 1 of an existing shutter box.

The present embodiment refers to a retrofit operation where the motor is mounted within tube 22. This retrofit will be feasible provided the existing shutter box is sufficiently large to house the components of the shutter 10 according to the present invention. As stated above the retrofit could have the motor mounted within tube 22.

Figure 5:
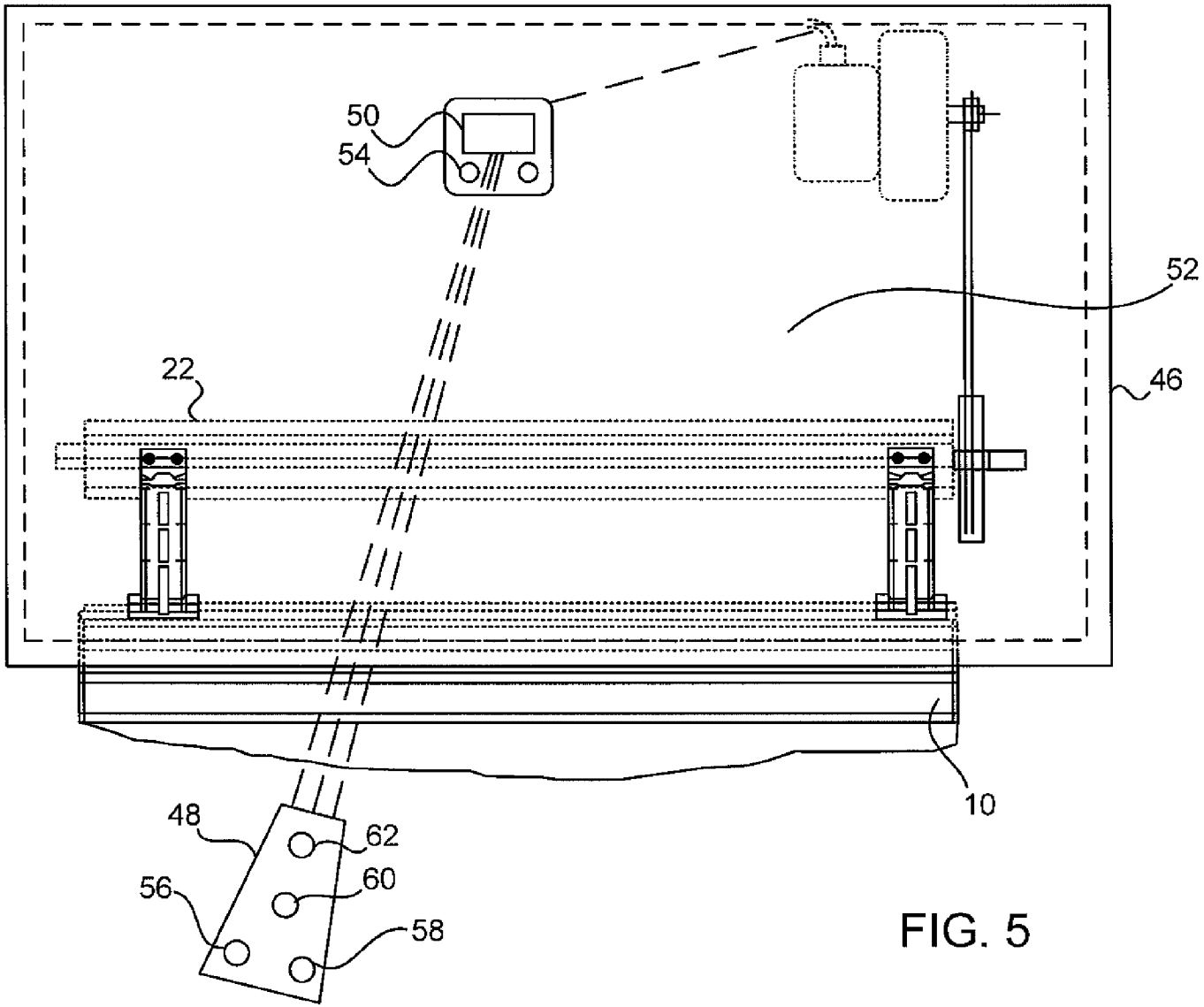
FIG. 5 is a view of a complete shutter intended primarily for buildings under construction.

Seen in FIG. 5 is a shutter 10 which further including the shutter box 46. In a retrofit application where the existing shutter box is too small, the shutter 10 according to the present invention is supplied together with its own shutter box 46.

A remote-control sender 48 and receiver 50 are provided. The receiver 50 is attached to the outside of a wall 52 of the shutter box 46, and has a POWER ON indicator 54. The sender 48 has four buttons: POWER ON 56, POWER OFF 58 (Optional), DOWN 60, and UP 62.

Figure 6:
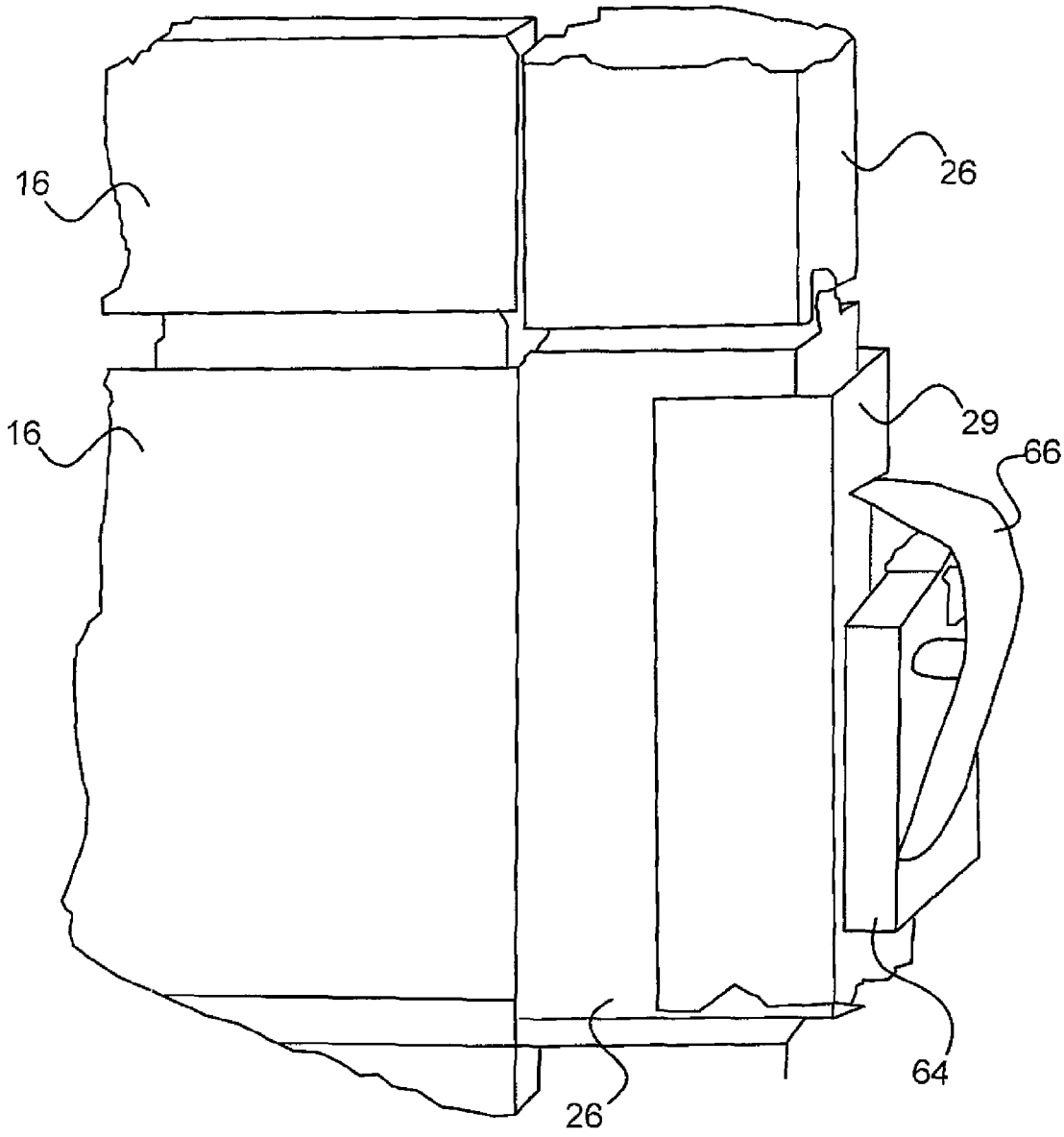
FIG. 6 is a perspective view of a detail of device view of a device preventing excessive UP movement of the shutter.

Referring now to FIG. 6, there is depicted a detail of a shutter further including automatic stop means to prevent the motor 32 seen in FIG. 1 from overriding the limit of the shutter up movement it should be noted that in case the motor is mounted within tube/shaft 22 automatic stop mean being provided.

A normally off switching device 64 has an actuator 66 in contact with the hinge blocks 26, whereby the switching device 64 is closed. If however the lowest hinge block passes above a limit point the actuator 66 opens the switching device 64. This causes the UP command to become temporarily unoperatable, until the DOWN command is activated. A similar arrangement can be built using a proximity switch.

Figure 7:
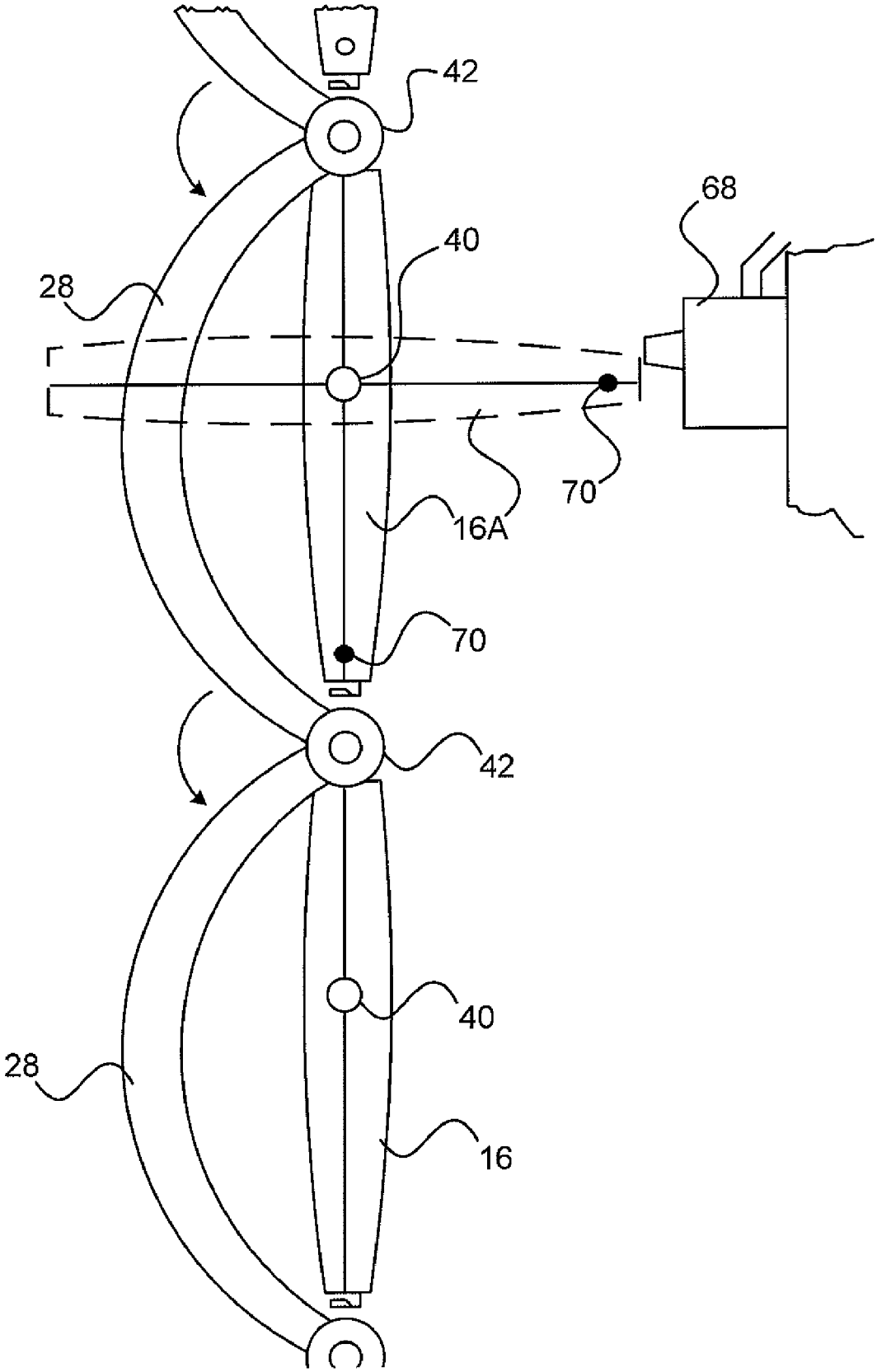
FIG. 7 is a view of a side view of an arrangement preventing excessive tilt movement of the shutter slats.

FIG. 7 shows a further detail of the shutter, further including automatic stop means to prevent the motor from overriding the limit of the down movement.

A normally on proximity switch 68 is positioned adjacent to a slat 16*a* in its tilted position shown in dotted lines. A metal insert 70 in the slat 16*a* is detected by the switch 68 which opens an electric circuit stopping the motor. The circuit is arranged so that the DOWN command becomes temporarily unoperatable until the UP command is entered. A similar arrangement can be built using a micro switch as seen in the previous figure.

The scope of the described invention is intended to include all embodiments coming within the meaning of the following claims. The foregoing examples illustrate useful forms of the invention, but are not to be considered as limiting its scope, as those skilled in the art will be aware that additional variants and modifications of the invention can readily be formulated without departing from the meaning of the following claims.

The invention claimed is:

1. An electrically driven roll-up shutter for a building opening, comprising a plurality of upper pivoted link elements each of which supports all lower components, the link elements being arranged to allow rolling-up on a shutter shaft or tube, the lowest of said link elements being attached to a slat tilt mechanism, said link elements are in tension when only the highest of said link elements is in contact with said shutter shaft or tube form a substantially straight line;

when rolled up and said link elements are in contact with said shutter shaft and take up a concave form;

when the shutter is fully deployed said link elements are in compression and form a convex curve and act as a push rod;

a plurality of interconnected shutter slats, rotatably suspended from opposed ends by one of a chain of interconnected pivoted hinge blocks, said hinge blocks being configured to slidingly engage a fixed vertical guide member provided at each side of said building opening, and said hinge blocks allowing at least 90 degree of slat swing on a horizontal axis and being interconnected by hinge elements to allow roll-up on a shutter shaft or tube, said shutter slats each having at an extremity a further pivot engaging said slat tilt mechanism;

a reversible electric motor geared to a speed reduction device operatively connected to drive said shutter shaft in either direction;

and user control means responsive to at least three commands to said motor including DOWN, UP, and OFF;

whereby said shutter may be electrically driven to a retracted position wherein a major portion of said shutter is rolled up;

a partially deployed position wherein said slats remain closed;

a stopped fully-deployed position wherein the lowest of said slats encounters an obstacle such as the floor or a fixed window frame; and a slat-open position wherein further operation of said motor, after said stopped fully-deployed position, activates said slat tilting mechanism allowing air and light to pass through said shutter.

2. The shutter for a building opening as claimed in claim 1 wherein said motor is mounted within said shaft or tube.

3. The shutter for a building opening as claimed in claim 1, wherein shutter shaft or tube is a cylindrical revolvable member.

4. The shutter for a building opening as claimed in claim 3, further including said cylindrical revolvable member being supported by bearings of a shutter box.

5. The shutter for a building opening as claimed in claim 1, further including automatic stop means to prevent the motor from overriding the up movement.

6. The shutter for a building opening as claimed in claim 1, further including automatic stop means to prevent the motor from overriding the tilt movement.

7. The shutter for a building opening as claimed in claim 1, wherein the highest of said upper pivoted link elements is provided with at least one aperture allowing passage for at least one fastener.

8. The shutter for a building opening as claimed in claim 1, wherein said upper pivoted link elements are formed to lie snugly against said shutter shaft or tube when said shutter is at least partially retracted.

* * * * *